United States Patent [19]

Driska

[11] Patent Number: 5,066,006

[45] Date of Patent: Nov. 19, 1991

[54] BASKET FOR BASKETBALL-TYPE GAME

[75] Inventor: John J. Driska, Princeton Junction, N.J.

[73] Assignee: Azrak-Hamway International Inc., New York, N.Y.

[21] Appl. No.: 651,737

[22] Filed: Feb. 7, 1991

[51] Int. Cl.[5] ..... A63B 63/08

[52] U.S. Cl. ..... 273/1.5 R; 273/389

[58] Field of Search ..... 273/1.5 R, 1.5 A, 389

[56] References Cited

U.S. PATENT DOCUMENTS

| | | | |
|---|---|---|---|
| 574,150 | 12/1896 | Heap et al. | 273/389 |
| 1,381,466 | 6/1921 | Jackson, Jr. | 273/1.5 R |
| 2,593,758 | 4/1952 | Holmdahl | 273/1.5 R |

*Primary Examiner*—Paul E. Shapiro

*Attorney, Agent, or Firm*—Amster, Rothstein & Ebenstein

[57] ABSTRACT

A basket for a basketball-like game wherein the player attempts to shoot a projectile (e.g., a basketball) downwardly through the opening of a basket, either directly or upon rebound from a backboard, comprising a basket defining a generally vertical opening therethrough (typically mounted on a backboard and projecting forwardly thereof). A member has the appearance of at least one hand, the member being pivotally mounted on the basket for movement between a slam dunk orientation, wherein the member at least partially covers the basket opening, and an at rest orientation, wherein the member is spaced from the basket opening to enable passage of the projectile through the basket. A lever is disposed at least partially in the basket opening and responsive to the passage of the projectile downwardly through the basket for moving the member from the at rest orientation to the slam dunk orientation. Thus, passage of a projectile downwardly through the basket opening is immediately followed by movement of the member from its at rest orientation to its slam dunk orientation so as to simulate the appearance of the projectile being slam dunked through the basket opening by the member.

13 Claims, 5 Drawing Sheets

BASKET FOR BASKETBALL-TYPE GAME

BACKGROUND OF THE INVENTION

The present invention relates to basketball-type games, and more particularly to a basket for use therein.

Especially in recent years the slam dunk shot in basketball has become especially popular with the viewing public. In the slam dunk shot the player, either because of his height or his ability to jump, or both, maintains contact with the basketball even as it begins to pass downwardly towards or through the opening of the basket or hoop. The slam dunk shot is a crowd-pleaser, perhaps because the basketball passes through the hoop with more kinetic energy than is the case in the usual shot and perhaps because the player often appears to defy gravity while making the shot. For most children and amateur basketball players of normal height, however, a slam dunk shot is beyond their physical capability, if not their imagination.

Accordingly, it is an object of the present invention to provide a basket for use in a basketball-like game wherein a successful non-slam dunk shot simulates the appearance of a slam dunk shot.

Another object is to provide such a basket enabling the player to vicariously enjoy making a simulated slam dunk shot.

A further object is to provide such a basket which is of sturdy and rugged construction and is easy to assemble, maintain and use.

SUMMARY OF THE INVENTION

It has now been found that the above and related objects of the present invention are obtained in a basket for a basketball-like game wherein the player attempts to shoot a projectile (e.g., a basketball) downwardly through the opening of a basket, either directly or upon rebound from a backboard, comprising a basket defining a generally vertical opening therethrough (typically projecting forwardly of a backboard). A slam dunk member, which preferably has the appearance of at least one hand, is pivotally mounted on the basket for movement between a slam dunk orientation, wherein the member at least partially covers the basket opening, and an at rest orientation, wherein the member is spaced from the basket opening to enable passage of the projectile through the basket. A means is disposed at least partially in the basket opening and responsive to the passage of the projectile downwardly through the basket for moving the member from the at rest orientation to the slam dunk orientation. Thus, passage of a projectile downwardly through the basket opening is immediately followed by movement of the member from its at rest orientation to its slam dunk orientation so as to simulate the appearance of the projectile being slam dunked through the basket opening by the member.

In a preferred embodiment the basket additionally includes means biasing the member towards the at rest orientation, the biasing means preferably being secured directly to the moving means and adapted to act on the member through the moving means. The moving means has one end portion operatively disposed within the basket opening and the other end portion operatively secured to the member.

The member in the at rest orientation has the appearance of at least one raised hand and in the slam dunk orientation has the appearance of at least one hand which is horizontal or lowered. Preferably the member has the appearance of a pair of hands. The basket may be adapted for use with a projectile resembling a reduced-scale basketball, with the basket and optional backboard being also of reduced scale relative to a regulation-sized basketball basket (and backboard).

Preferably the basket and the backboard are substantially fixedly secured on a support, while the moving means is pivotally secured to the backboard through the basket.

BRIEF DESCRIPTION OF THE DRAWING

The above brief description, as well as further objects and features of the present invention, will be more fully understood by reference to the following detailed description of the presently preferred, albeit illustrative embodiments of the present invention when taken in conjunction with the accompanying drawing wherein.

DETAILED DESCRIPTION OF THE PREFERRED EMBODIMENTS

Figure 1:
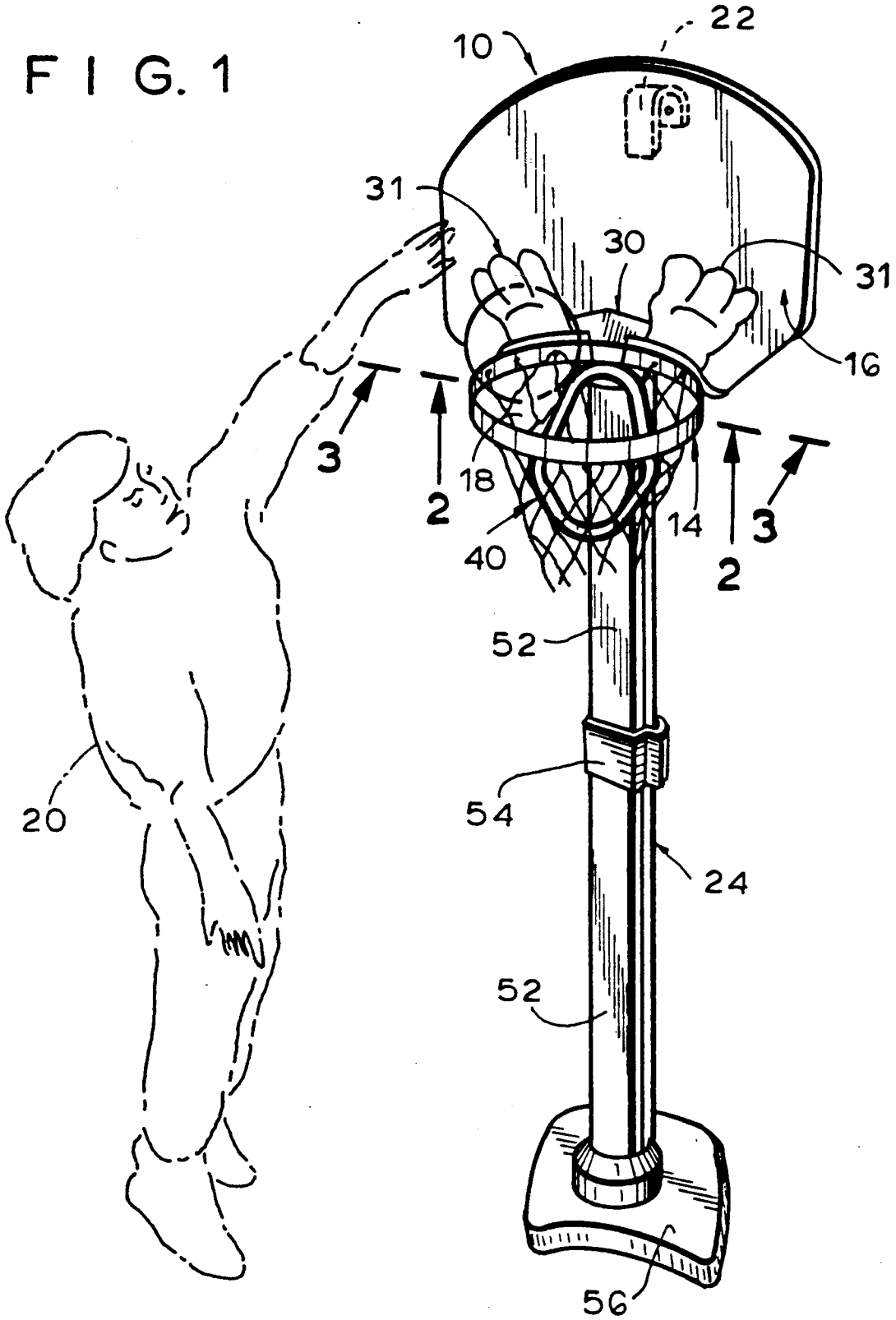
FIG. 1 is an isometric view of a basket and backboard according to the present invention in use by a player (in phantom line) throwing a ball (also in phantom line) through the basket.

Referring now to the drawing, in particular to FIG. 1 thereof, therein illustrated is a backboard and basket combination generally designated by the reference numeral 10, wherein a basket or hoop according to the present invention, generally designated 14, and a backboard 16 are both mounted on a common support 24. The combination 10 is adapted for use in a basketball-like game wherein the player 20 (illustrated in phantom line) attempts to shoot a projectile, such as a basketball 12 (illustrated in phantom line), downwardly through the opening 18 of the basket 14. The basketball 12 can be shot into the basket opening 18 either directly or upon rebound from the backboard 16.

The principles of the present invention apply to the basketball-like game regardless of whether the game is a full or regulation-size basketball game, a miniature basketball-like game, or something therebetween. Exemplary of the miniature basketball-like games is the type wherein a reduced size basket is fixed to a reduced size backboard 16 having a hook 22 extending rearwardly from the back thereof for mounting on the rim of a wastebasket (not shown), and the player attempts to shoot crumpled waste paper or like objects (as projectiles) into the wastebasket through the basket. The basket 14, the hook 22, or the backboard 16 itself, may be apertured to permit mounting of the basket or the backboard and basket combination on a nail. Such games are particularly popular in an office setting where the worker/player attempts to derive a certain job satisfaction from the otherwise mundane task of throwing waste paper into a wastebasket. In view of this general applicability of the principles of the present invention, its description hereinbelow will be without reference to the size of the projectile, basket, or backboard.

Figure 4:
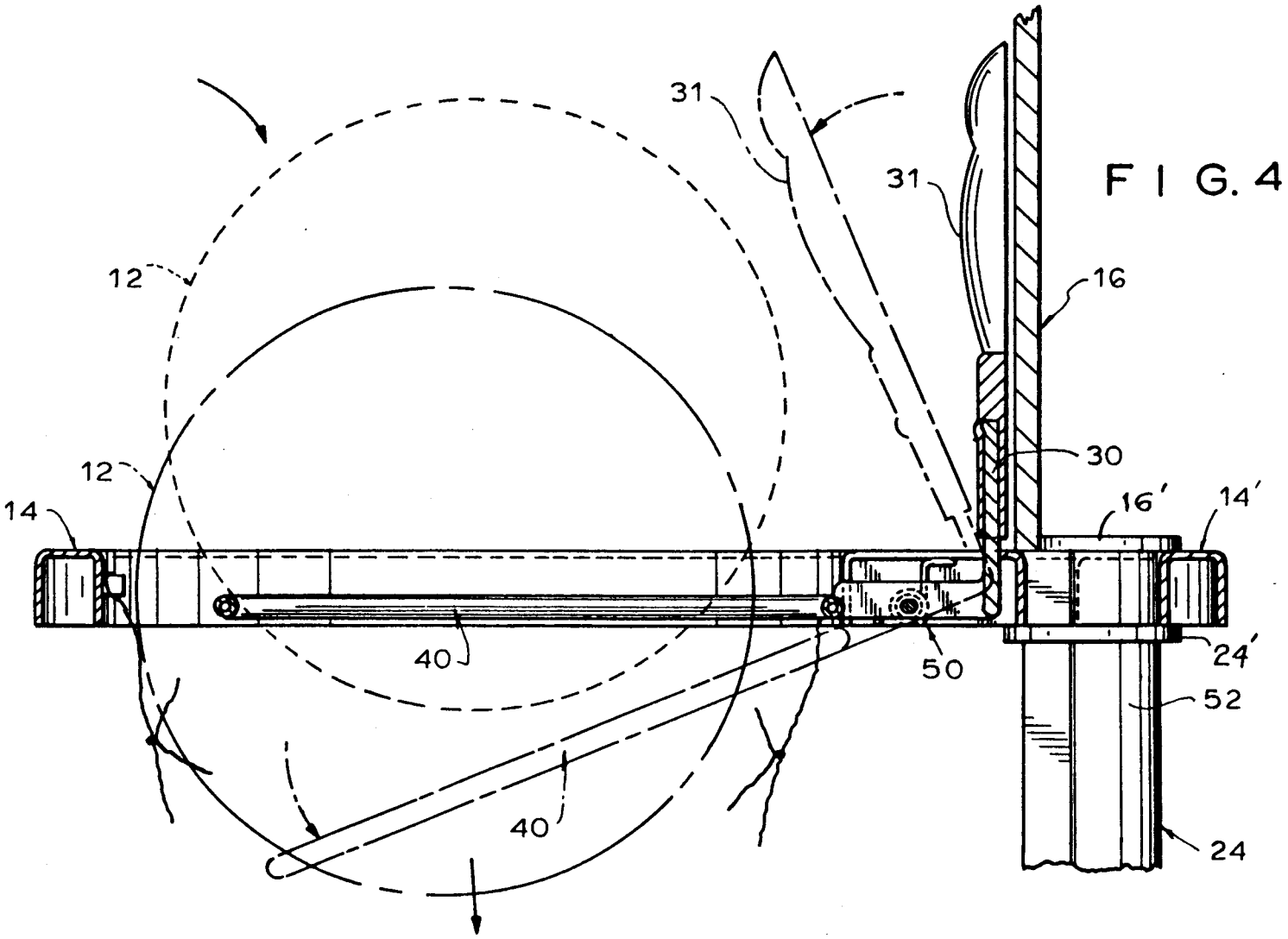
FIG. 4 is a fragmentary side elevational view of the basket, backboard and stand, partially in section and taken along the line 4—4 of FIG. 3, with the ball (in phantom line) being shown in two orientations passing through the basket, the initial orientation of the basket being illustrated in solid line and an intermediate orientation of the basket being illustrated in phantom line.
Figure 5:
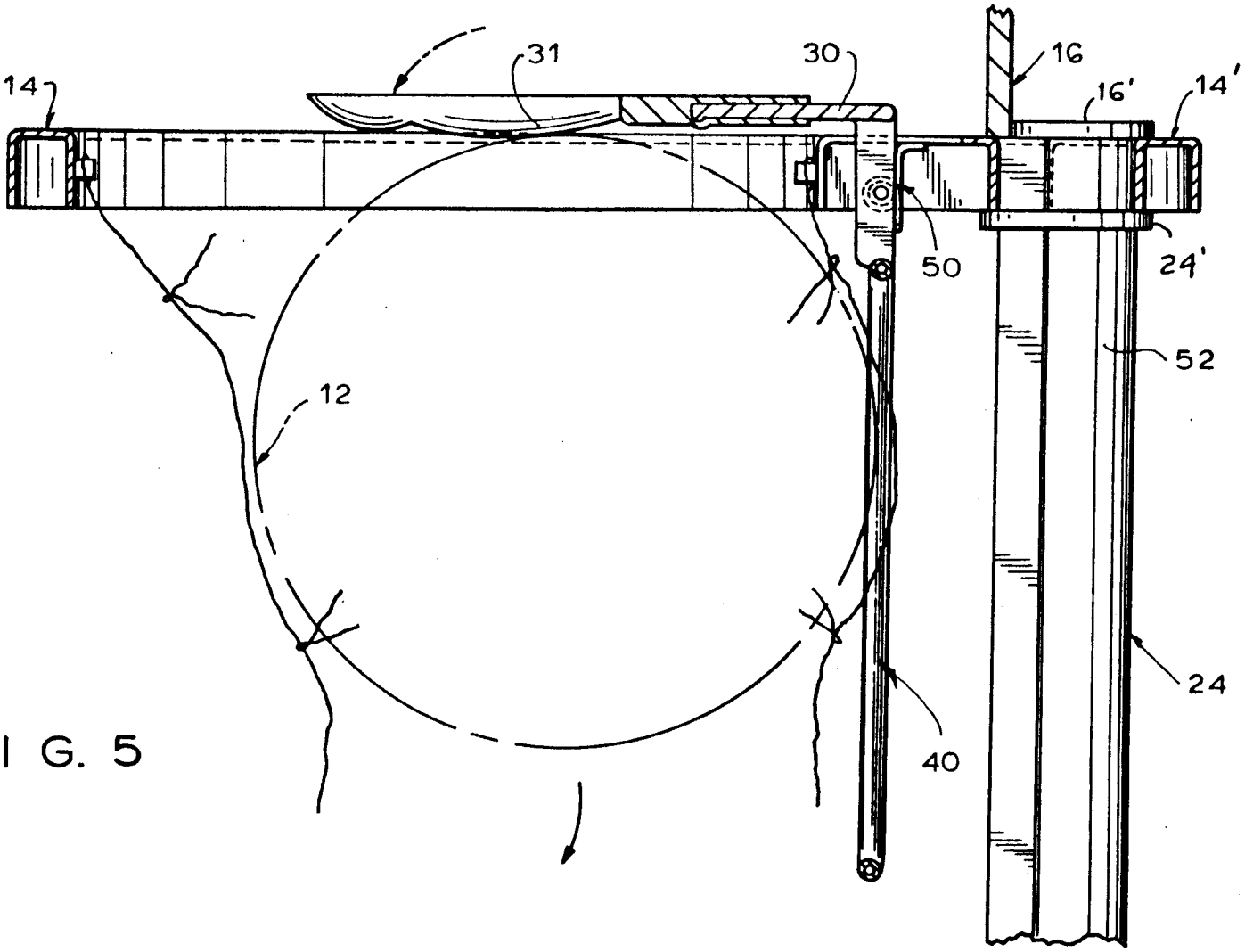
FIG. 5 is a fragmentary side elevational view, similar to FIG. 4, but with the basket illustrated in its final orientation as a ball (in phantom line) passes therethrough.

In its conventional aspects the basket 14 defines a generally vertical opening therethrough. Optionally a net is affixed thereto, as illustrated, to slow the passage of the basketball 12 through the basket 14 and avoid disputes as to whether or not the basketball 12 actually passed through the basket 14. The basket 14 is operatively mounted on and projects forwardly from a backboard 16. The backboard 16 typically projects upwardly and laterally of the basket 14, thereby to enable the basketball 12 to be shot into the basket 14 upon rebounding from the backboard 16. The basket 14 and any backboard 16 are typically suspended by connection to a support, generally designated 24, which may rise from the floor (as illustrated), descend from the ceiling, or extend from an intermediate support—e.g., a nail on a wall. To this end the back portion 14' of the basket 14 and the bottom portion 16' of any backboard 16 preferably define mounting apertures enabling them to be mounted on an upper male portion of the common support 24 above a supporting collar 24' of enlarged diameter (as best seen in FIGS. 4 and 5). In miniature basketball-like games, the basket 14 and any backboard 16 may be joined together (e.g., by a common shaft) and affixed to a wastebasket or the like using hook 22.

Preferably the basket 14 and any backboard 16 are held in a substantially fixedly relative orientation by their common mounting on support 24, although in particular applications the basket 14 may be disposed in a yielding, but biased construction which permits temporary deflection of the basket 14 downwardly from its normal orientation so that it yields temporarily rather than breaks when unexpected weight is placed thereon (for example, when a player making a slam dunk shot grabs the basket rim as he is descending).

Figure 2:
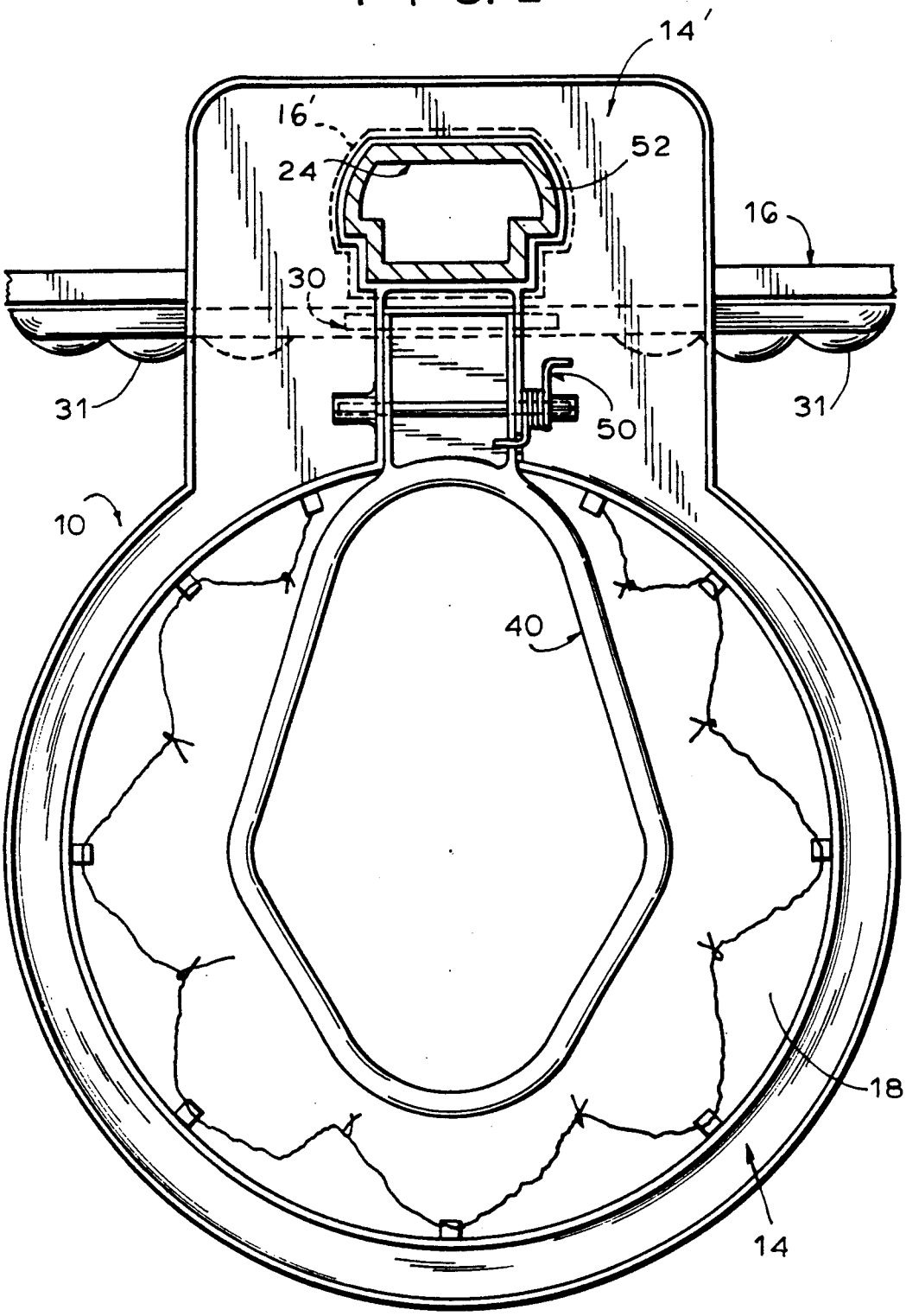
FIG. 2 is a fragmentary bottom plan view, to an enlarged scale, partially in section and taken along the line 2—2 of FIG. 1.
Figure 3:
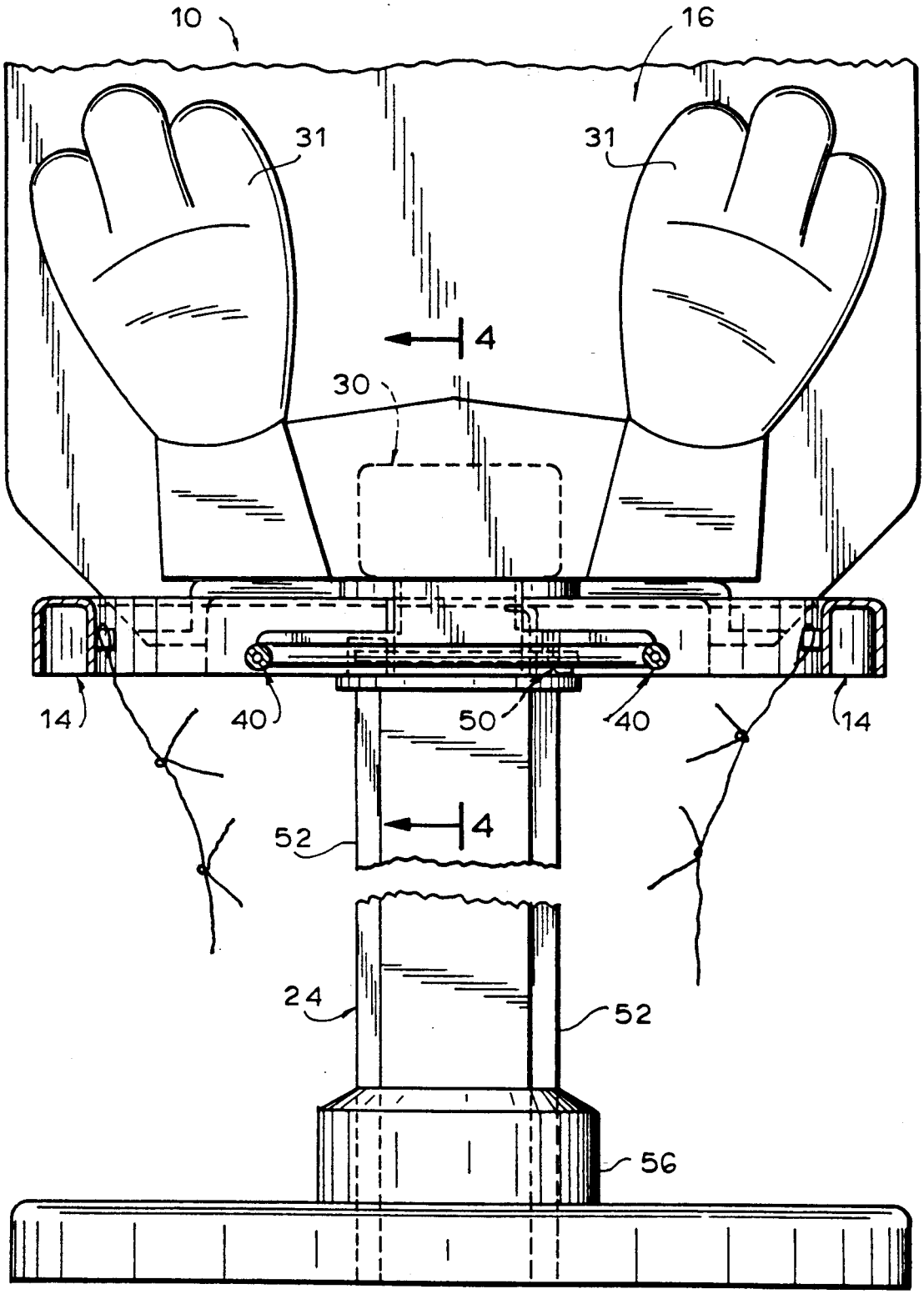
FIG. 3 is a fragmentary front elevational view of the basket, the backboard and a stand therefor, partially in section and taken along the line 3—3 of FIG. 1.

Referring now to FIGS. 2 and 3 as well, in its novel aspects the present invention additionally includes a member, generally designated 30, having the appearance of at least one hand 31 and preferably a pair of hands 31 in the open position, as they would be when used in making a slam dunk shot. The hand or hands represented may be human hands, animal hands or paws, or the like, the latter being especially preferred for miniature basketball-like games. The member 30 is pivotally mounted on the basket 14 for movement between an at rest orientation (see FIG. 3 and the solid line orientation of FIG. 4) wherein the member 30 is spaced from the basket opening 18 to enable passage of the basketball 12 through the basket 14, and a slam dunk orientation (see the orientation of FIG. 5) wherein member 30 at least partially covers the basket opening 18. The member 30 in its at rest orientation simulates the appearance of a hand or hands which are being raised (as if to block the shot being attempted) and in its slam dunk orientation simulates the appearance of hand or hands which are horizontal or tilted downwardly (as if following the basketball 12 through the basket opening 18).

While the member 30 is illustrated as being pivotally mounted directly on the basket 14, alternatively the member 30 may be pivotally mounted directly on the backboard 16 without any substantial change in the functioning thereof.

Lever means, generally designated 40, are operatively disposed at least partially in the basket opening 18, so as to be responsive to the passage of the basketball 12 downwardly through the basket 14, for moving the member 30 from its at rest orientation to its slam dunk orientation. Preferably lever means 40 has one end portion (illustrated in FIG. 2 as generally diamond shaped) operatively disposed at least partially in the basket opening for displacement by the basketball 12 as it passes through the basket opening 18, and the other end portion secured to the member 30 so that the downward displacement of the first end portion under the weight of a basketball 12 passing through basket 14 results in the member 30 being pivoted from its at rest orientation (see FIG. 3 and the solid line orientation of FIG. 4) to its slam dunk orientation (see FIG. 5). While the lever means 40 is preferably a rigid lever rigidly supporting member 30 for pivotal movement as a unit, as illustrated, the end portion thereof contacting member 30 and the body portion thereof intermediate the end portions may alternately be a flexible, but preferably nonextendible, connector, such as rope, which performs the same function.

The basket 14 preferably includes means 50 for biasing the member 30 towards its at rest orientation. The biasing means 50 may be secured directly to the member 30, as illustrated, or secured directly to the moving means 40 and adapted to act on the member 30 through the moving means 40. Any conventional biasing mechanism may be used as the biasing means 50, including torsion coil springs (as illustrated), spring leaves, and the like suitable for the particular application (e.g., the size of the basketball-like game).

To play the game, the user shoots the basketball 12 or like projectile (e.g., crumpled waste paper) through the basket opening 18, either directly or upon rebound from the backboard 16. The passage of the basketball 12 downwardly through the basket opening 18 acts on the end portion of lever means 40 disposed at least partially in the basket opening 18 (see FIG. 3) by causing such portion to retreat from the basket opening 18. This movement of the lever means 40 forces the member 30 (including its hands 31) to move from its at rest orientation to its slam dunk orientation (see FIG. 5), thereby simulating the appearance of the basketball 12 being slam dunked through the basket opening 18 by the hands 31 of member 30. To the extent that the player identifies his hands with the hands 31 represented on member 30, the player vicariously enjoys the thrill and excitement of himself making a simulated slam dunk shot.

As the basketball 12 causes the end portion of lever means 40 to retreat from the basket opening 18, the basketball 12 is free to continue its movement downwardly through the basket 14. At some time, the basketball 12 passes downwardly below the displaced end portion of lever means 40, thereby allowing the displaced end portion of lever means 40 to return to its normal or at rest position at least partially within the basket opening 18 under the influence of the biasing means 50. The returning motion of the lever means 40 causes the member 30 to return to its original at rest orientation, and the member 30 and lever means 40 are then positioned ready for the next shot.

The basket/backboard support 24 preferably includes a pair of axial poles 52 which are telescopically connected at 54 in order to permit adjustment of the height of the support 24, and thus the height of the basket 14 when attached to the free end of the upper support pole 52. The telescopic feature also permits the support 24 to be shipped and stored in a relatively short carton. A base 56 of a large diameter relative to the support 24 is removably securable to the free end of the lower support pole 52 in order to stabilize the entire structure on a floor. It will be appreciated that a support 24 having a plurality of telescopically adjustable poles 52 and a removably securable base 56 therefor are well known in the basketball art and hence further description thereof is not deemed necessary herein. Further, the means for mounting a basket 14 and a backboard 16 on a support 24 (as illustrated in FIG. 2) are well known in the art and hence need not be described herein.

For shipping purposes, the member 30, the basket 14 (including lever means 40 and biasing means 50), the backboard 16, the support 24, and the support base 56 may all be separable. The separated components may be easily assembled by mounting the member 30 on an appropriate stub provided therefor on lever means 40. The basket 14 and backboard 16 are then optionally mounted (by back and bottom portions 14', 16') at the top end of the support 24 above collar 24', and the base 56 is mounted at the bottom end thereof.

To summarize, the present invention provides a basket for use in a basketball-like game wherein a successful non-slam dunk shot simulates the appearance of a slam dunk shot, thereby enabling the player to vicariously enjoy making a simulated slam dunk shot. The basket is of sturdy and rugged construction and is easy to assembly, maintain and use.

Now that the preferred embodiments of the present invention have been shown and described in detail, various modifications and improvements thereon will become readily apparent to those skilled in the art. Accordingly, the invention is to be construed broadly in a manner consistent with the spirit and scope of the appended claims, and not limited by the foregoing disclosure.

I claim:

1. A basket for a basketball-like game wherein the player attempts to shoot a projectile downwardly through the opening of a basket, either directly or upon rebound from a backboard, comprising:

(A) a basket defining a generally vertical opening therethrough;

(B) a slam dunk member pivotally mounted on said basket for movement between a slam dunk orientation, wherein said member at least partially covers said basket opening, and an at rest orientation, wherein said member is spaced from said basket opening to enable passage .of the projectile through said basket; and (C) means disposed at least partially in said basket opening and responsive to the passage of the projectile downwardly through said basket for moving said member from said at rest orientation to said slam dunk orientation;

whereby passage of a projectile downwardly through said basket opening is immediately followed by movement of said member from its at rest orientation to its slam dunk orientation so as to simulate the appearance of the projectile being slam dunked through said basket opening by said member.

2. The basket of claim 1 additionally including means biasing said member towards said at rest orientation.

3. The basket of claim 2 wherein said biasing means is secured directly to said member.

4. The basket of claim 2 wherein said biasing means is secured directly to said moving means and adapted to act on said member through said moving means.

5. The basket of claim 1 wherein said moving means has one end portion operatively disposed within said basket opening and the other end portion operatively secured to said member.

6. The basket of claim 1 wherein said member has the appearance of at least one hand.

7. The basket of claim 6 wherein said member in said at rest orientation has the appearance of at least one raised hand and in said slam dunk orientation has the appearance of at least one hand which is horizontal or lowered.

8. The basket of claim 6 wherein said member has the appearance of a pair of hands.

9. The basket of claim 1 for use with a projectile resembling a reduced-scale basketball wherein said basket is of reduced scale relative to a regulation-sized basketball basket.

10. The basket of claim 1 additionally including a backboard, said basket projecting forwardly of said backboard.

11. The basket of claim 10 additionally including a support, said basket and said backboard being substantially fixedly mounted on said support.

12. The basket of claim 10 wherein said moving means is pivotally secured to said backboard through said basket.

13. A basket for a basketball-like game wherein the player attempts to shoot a projectile downwardly through the opening of a basket, either directly or upon rebound from a backboard, comprising:

(A) a backboard;

(B) a basket defining a generally vertical opening therethrough projecting forwardly of said backboard, said backboard and basket being of reduced scale relative to a regulation-sized basketball backboard and basket;

(C) a slam dunk member having the appearance of at least one hand, said member being pivotally mounted on said basket for movement between a slam dunk orientation, wherein said member at least partially covers said basket opening, and an at rest orientation, wherein said member is spaced from said basket opening to enable passage of the projectile through said basket, said member in said at rest orientation having the appearance of at least one raised hand and in said slam dunk orientation having the appearance of at least one hand which is horizontal or lowered;

(D) moving means having one end portion operatively disposed at least partially in said basket opening and another end portion operatively secured to said member, said moving means being responsive to the passage of the projectile downwardly through said basket for moving said member from said at rest orientation to said slam dunk orientation; and (E) means biasing said member towards said at rest orientation;

whereby passage of a projectile downwardly through said basket opening is immediately followed by movement of said member from its at rest orientation to its slam dunk orientation so as to simulate the appearance of the projectile being slam dunked through said basket opening by said member.

* * * * *